United States Patent [19]

Ibrahim

[11] 4,414,822

[45] Nov. 15, 1983

[54] REFRIGERATED DISPLAY CASE WITH COLLIDING BAND AIR DEFROST

[75] Inventor: Fayez F. Ibrahim, Niles, Mich.

[73] Assignee: Tyler Refrigeration Corporation, Niles, Mich.

[21] Appl. No.: 226,769

[22] Filed: Jan. 21, 1981

Related U.S. Application Data

[63] Continuation-in-part of Ser. No. 70,882, Aug. 29, 1979, Pat. No. 4,341,081, and Ser. No. 11,804, Feb. 14, 1979, abandoned.

[51] Int. Cl.[3] ..... A47F 3/04

[52] U.S. Cl. ..... 62/256; 62/151; 62/80

[58] Field of Search ..... 62/256, 255, 151, 80

[56] References Cited

U.S. PATENT DOCUMENTS 4,026,121 5/1977 Aokage et al. ..... 62/256

*Primary Examiner*—Albert J. Makay
*Assistant Examiner*—Henry Bennett
*Attorney, Agent, or Firm*—LeBlanc, Nolan, Shur & Nies

[57] ABSTRACT

A refrigerated display case having a display space and an access opening, reversible fans for circulating air through an inner air conduit and across the access opening between a first outlet and a first inlet in a refrigeration mode to establish a primary air band; a second set of fans for circulating air through a second air conduit and across the access opening adjacent to and outwardly of the inner primary air band between a second outlet and second inlet to establish a secondary air band; and defrost cycle control means for reversing the air flow direction of the primary air band during a defrost cycle while maintaining the air flow direction of the second air band continuously in the same direction during both refrigeration and defrost cycles. The primary band inlet region and secondary band outlet region are so aligned as to cause primary band air flowing out of the inner inlet duct to collide with secondary band air flowing out of the secondary outlet duct to substantially reverse the primary band air flow direction and cause a substantial part of the primary band to flow outside the display case adjacent to and along the front of the case.

10 Claims, 4 Drawing Figures

REFRIGERATED DISPLAY CASE WITH COLLIDING BAND AIR DEFROST

CROSS REFERENCE TO RELATED APPLICATIONS

The present application is a continuation-in-part of my copending application Ser. No. 70,882, filed Aug. 29, 1979, now U.S. Pat. No. 4,341,081 issued July 27, 1982 titled MULTIBAND OPEN FRONT REFRIGERATED CASE WITH AIR DEFROST, and of my copending application Ser. No. 11,804 filed Feb. 14, 1979 now abandon, titled OPEN TOP MULTIBAND REFRIGERATED DISPLAY CASE. Both said copending applications are assigned to the same assignee as the present invention. The disclosures of both said copending applications are incorporated herein by reference.

BACKGROUND OF THE INVENTION

The present invention relates to refrigerated display cases having an ambient air defrost system. More particularly, the invention relates to an air defrost system in which adjacent air bands flow in opposite directions in defrost. This causes the bands to collide and direct a part of the air outside the case.

All references herein to refrigeration apparatus or refrigeration operations are intended to include cooling at a temperature below 32° F., such as associated with frozen food display cases, or below 0° F., such as with ice cream cases, or in excess of 32° F., such as typically associated with dairy, fresh meat and produce display cases.

In the operation of commercial refrigerated display cases, of the type found for example, in supermarkets and the like, it is desirable to include a system capable of automatically defrosting the display case. Preferably, the defrost cycle is actuated either at preset periodic times or when the frost buildup within the system has reached a certain predetermined level. The system may be controlled to begin the defrost operation at a preset time or times as set on a master control clock; defrost termination is usually thermostatically controlled, with a fail-safe clock-controlled maximum defrost time period. Alternatively, the system may be thermostatically controlled so as to switch from the refrigeration cycle to the defrost cycle when a preset level of frost buildup is detected. By either manner of operation, it is possible to avoid significant frost buildup within the display case.

Typically, three main approaches have been employed in the past for defrosting refrigerated display cases. The first approach involves the use of electric resistance heaters that are arranged adjacent to the refrigeration coils of the refrigeration mechanism. During a defrost cycle, these heaters are energized to radiate heat in an effort to eliminate the frost buildup on the coils; this also adds heat to the air being circulated through the conduit within the case. This electric defrost is relatively simple both in construction and operation. No additional moving parts are required, although it is generally necessary to install an additional three-phase 220 V. line for the heater circuit. The electrical heaters are high wattage heaters, and thus utilize a substantial amount of electricity during operation. Furthermore, the additional warm air being circulated in the case due to the radiant heat from the heaters can raise the temperature of the case above desirable limits, thereby increasing the risk of product spoilage.

A second type of defrost system in use circulates relatively high temperature, high pressure compressed gaseous refrigerant through selected evaporator coils in the defrost cycle in the opposite direction to the flow of refrigerant through the evaporator coils during the refrigeration cycle. During the defrost cycle, a valve mechanism shuts off the supply of low temperature liquid refrigerant to the evaporator coils to be defrosted and instead routes the compressed hot gaseous refrigerant through the coils for defrosting. Gas defrost requires additional expensive mechanical components, including an extra several hundred feet or more of refrigerant carrying conduit, valves, solenoids, etc. All of these elements are subject to rapid and extreme temperature shifts, and resulting expansion, particularly at the start and end of a defrost cycle. Due to the requirement that the system be able to be selectively switchable to supply hot gaseous refrigerant to selected ones (but not all) of the evaporator coils, a complicated valving and control structure must be provided.

A third, relatively recently developed approach to defrosting display cases relies upon naturally warm ambient air. An example of an ambient air defrosting system which has proven to be commercially successful is shown in U.S. Pat. No. 4,144,720 to Subera et al, which is assigned to the same assignee as the present invention. The Subera '720 patent discloses an open front refrigerated display case having primary and secondary air conduits. During a defrost cycle, the direction of air flow through the secondary conduit is reversed to draw in air from outside the display case. This ambient air is directed into the primary band conduit where it is forced to flow over the evaporator coils and defrost them. A feature of the system shown in the Subera '720 patent is that the primary band air flow is continuously maintained in both the refrigeration and defrost cycles, whereby an air curtain is maintained across the access opening at all significant times.

Other reversible fan air defrost systems are shown in U.S. Pat. No. 4,026,121 to Aokage et al and U.S. Pat. No. 4,120,174 to Johnston. Other air defrost systems generally are shown in U.S. Pat. Nos. 3,082,612; 3,403,525; 3,850,003; and 3,937,033, all to Beckwith et al.

SUMMARY OF THE INVENTION

This invention is directed to an air defrost system for use in a refrigerated display case of the open top well type or the upright open front type. The open front type has a display space and a front access opening for enabling access to products displayed on shelves in the display space. Reversible fans circulate air through an inner air conduit passing around the display space and downwardly across the access opening between outlet and inlet ducts to establish a primary refrigerated air band and a primary air curtain in a refrigeration mode. A second set of fans circulates air through a secondary air conduit passing around the cabinet adjacent to the inner air conduit but outwardly therefrom and downwardly across the access opening between outlet and inlet ducts to establish a secondary, non-refrigerated air band with a secondary air curtain in the refrigeration mode.

In the defrost cycle of this invention, control means reverse the air flow direction of the reversible fans in the inner conduit and maintain the air flow direction of the second set of fans continuously in the same direction during both refrigeration and defrost cycles. The primary band inlet region and secondary band outlet region are so aligned as to cause primary band air flowing out of the inner inlet duct to collide with secondary band air flowing out of the secondary outlet duct to substantially reverse the primary band air flow direction. A substantial portion of the primary band air flows downwardly outside the display case adjacent to and along the front of the case.

In a second embodiment, the air defrost system of the invention is used in a multiband open top display case. In the defrost cycle, control means reverse the air flow direction of the reversible fans in the inner conduit while maintaining the air flow direction of the second set of fans the same as in the refrigeration cycle. The primary band inlet region and secondary outlet region are so aligned as to cause primary band air flowing in a reverse direction across the open top of the case to collide with secondary band air flowing out of the secondary outlet. A first portion of the primary band air flow toward and into the primary band inlet; a second portion of the primary band air is further reversed under the influence of the continuously maintained secondary air band. One portion of the further reversed primary band air is directed toward and into the secondary inlet; a second portion of the further reversed air flows outwardly over the top of the display case and downwardly adjacent the exterior of the case.

DESCRIPTION OF THE PREFERRED EMBODIMENTS

Figure 3:
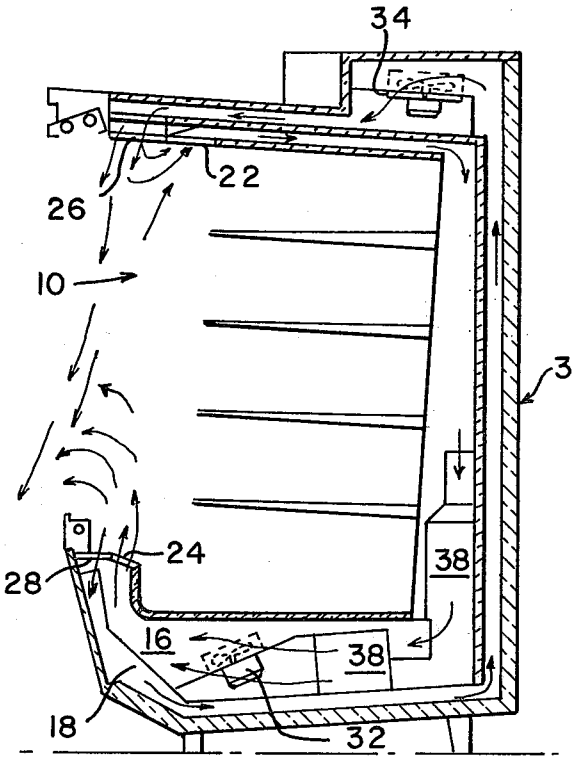
FIG. 3 shows a variation of the open front refrigerated display case in the defrost mode.
Figure 2:
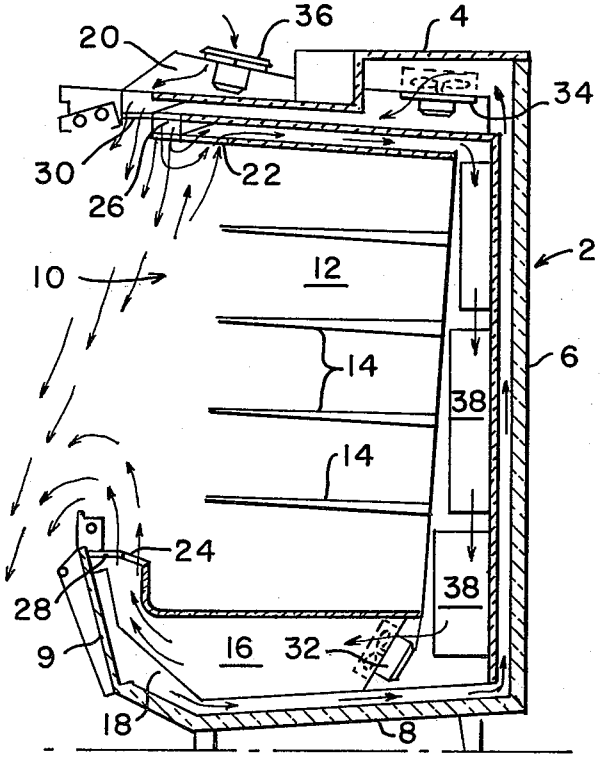
FIG. 2 shows the open front refrigerated display case in the defrost mode of this invention.
Figure 1:
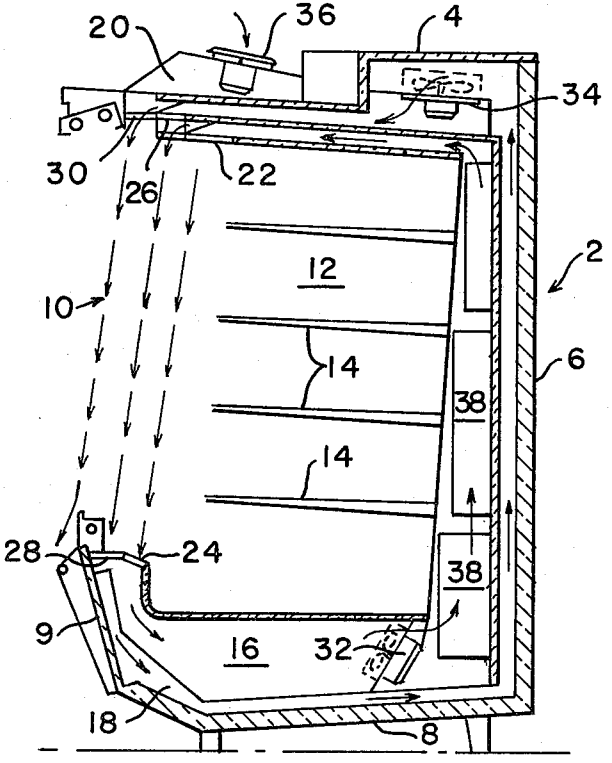
FIG. 1 shows an upright open front refrigerated display case in the refrigeration mode.

FIGS. 1–3 show the present invention in connection with a multiband, open front refrigerated display case 2 having a top wall 4, a rear wall 6, a bottom wall 8 and a front wall 9. Located within the front wall is a front access opening 10. A plurality of product display shelves 14 are arranged in the interior 12 of display case 2.

Primary and secondary air conduits 16 and 18, respectively, encircle the display case and extend along top wall 4, rear wall 6 and bottom wall 8. Primary conduit 16 contains refrigeration coils 38; conduit 16 has an outlet opening 22 located at the top end of access opening 10 and an inlet opening or return 24 located at the bottom end of access opening 10. Outlet opening 22 and inlet opening 24 are substantially aligned so that air exiting from outlet opening 22 is directed toward and into inlet opening or return 24. Secondary air conduit 18 substantially surrounds primary air conduit 16. Secondary conduit 18 has an outlet opening 26 and an inlet opening or return 28. These openings are in substantial alignment so that air exiting from the conduit 18 through outlet opening 26 is directed toward and received back into the conduit 18 through inlet opening 28.

Air is circulated through primary conduit 16 by one or more fans 32. Air is circulated through secondary conduit 18 by one or more fans 34. The number of fans actually utilized depends on the length of the refrigerated case, the size of the fans and the temperature level to which the case is to be cooled. Fans 32 are preferably of the reversible motor type, for reasons which will become clear below. However, any other suitable mechanism, such as disclosed in the aforementioned Subera '720 patent, may be used which permits the air flow direction to be selectively reversed in conduit 16.

During the refrigeration cycle, air passes through primary conduit 16 and over refrigeration coils 38 where the air is cooled. The refrigerated air in conduit 16 and somewhat warmer air in conduit 18 exits through outlet openings 22 and 26, respectively, and is directed across access opening 10 to form a refrigerated air curtain and a guard curtain, respectively, across the opening.

The air flow directions through the primary and secondary conduits during the refrigeration cycle are shown in FIG. 1. As can be seen, the refrigerated air curtain is established by the air leaving outlet opening 22 and re-entering inlet opening or return 24. This refrigerated air curtain serves to cool the interior 12 of display case 2 and thereby refrigerates products stored therein. The secondary air curtain that is formed by the air leaving outlet opeing 26 and re-entering inlet opening or return 28 serves to protect the refrigerated air curtain from the ambient air outside the display case.

FIGS. 1 and 2 show an upright display case having a further protective barrier, in the form of a third, ambient air curtain formed outside the secondary air curtain. One or more fans 36 draw in ambient air from outside of the display case and propel it through conduit 20 to exit from outlet opening 30. The air leaving outlet opening 30 passes along the front of the display case and is directed toward the floor at a location outside of front wall 9 of case 2. The ambient air curtain serves to protect both the primary and secondary air curtains during the refrigeration mode, as shown by the arrows in FIG. 1.

During the refrigeration cycle, a buildup of condensation and frost on the refrigeration coils takes place. As this buildup of frost continues, the passages through the refrigeration coils become partially or totally blocked. Consequently, it is periodically necessary to defrost refrigeration coils 38. The defrost cycle can be started either on a set periodic time basis or automatically as a function of the amount of frost buildup on the coils.

During the defrost cycle, the flow of refrigerant through refrigeration coils 38 is shut off, as by a suitable solenoid controlled valve arrangement (as is well known to those skilled in the design, construction and operation of commercial refrigeration apparatus), so that the air passing through conduit 16 will no longer be refrigerated. The direction of air flow through conduit 16 is reversed, as shown by the arrows in FIGS. 2 and 3. With such reverse air flow, air is drawn into the outlet openings 22 at the top of access opening 10, circulates through the conduit 16 and then exits from the inlet opening 24 at the bottom of access opening 10.

The air flow in the secondary conduit 18 is maintained continuously in the same direction during both the refrigeration and defrost cycles. Advantageously and preferably, the velocity and volume of the secondary band flow remains substantially the same in both the refrigeration and defrost cycles. Air flow through the ambient band conduit 20 will also be maintained in the same direction (at substantially the same velocity and volume of flow) during both the refrigeration and defrost cycles. By reversing only the refrigeration band and maintaining the secondary and ambient bands in the same direction, the air exiting from primary inlet or return 24 collides with the air stream forming the secondary and ambient air curtains. The primary band is thus forced to bend in a reverse direction and is directed towards floor level.

The defrost arrangement described above with respect to FIG. 2 substantially obviates a potential shortcoming of the invention described in aforementioned copending application Ser. No. 70,882. There, during defrost, when the primary band air flow is reversed, cold air exiting from inlet 24 may have sufficient velocity to be directed toward a customer standing directly in front of the case. In commercial establishments, such as supermarkets, a display case or group of cases may be defrosted two or three times a day. Increasingly, food markets are tending to remain open for business 24 hours a day. Thus, the problem of customer discomfort due to being hit with cold defrost air is becoming more and more prevalent.

In the defrost arrangement of this invention, the secondary and ambient band flows are maintained in the same direction and at substantially the same rate as during the refrigeration cycle. This downwardly flowing air collides with the upwardly flowing air exiting from the primary band return duct 24 and forces it down toward the floor (away from the customer's face and body area). Another advantage of the present invention is that an air curtain is always maintained across the opening of the display case to thereby substantially prevent an undue amount of warm ambient air from entering the display space 12 and warming the products stored therein.

FIG. 3 shows a variation of the above-described embodiment, in which ambient band conduit 20 along with its fans 36 are eliminated. The display case is generally designated 3 for convenience; in all other respects, like parts are identified by the same references used above. The operation of the display case 3 during the refrigeration cycle is essentially the same as that described above with reference to FIG. 1, except that the ambient air curtain is removed. During the defrost cycle, the two-band display case 3 operates and performs in essentially the same way as the three band display case 2 described above with respect to FIG. 2, except for the omission of the ambient air curtain.

Figure 4:
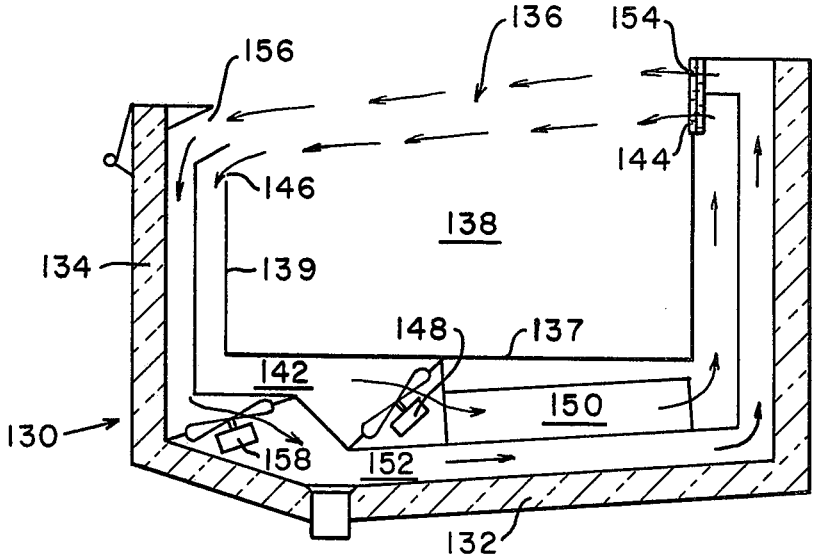
FIG. 4 shows an open top well type refrigerated display case in the refrigeration mode.
Figure 5:
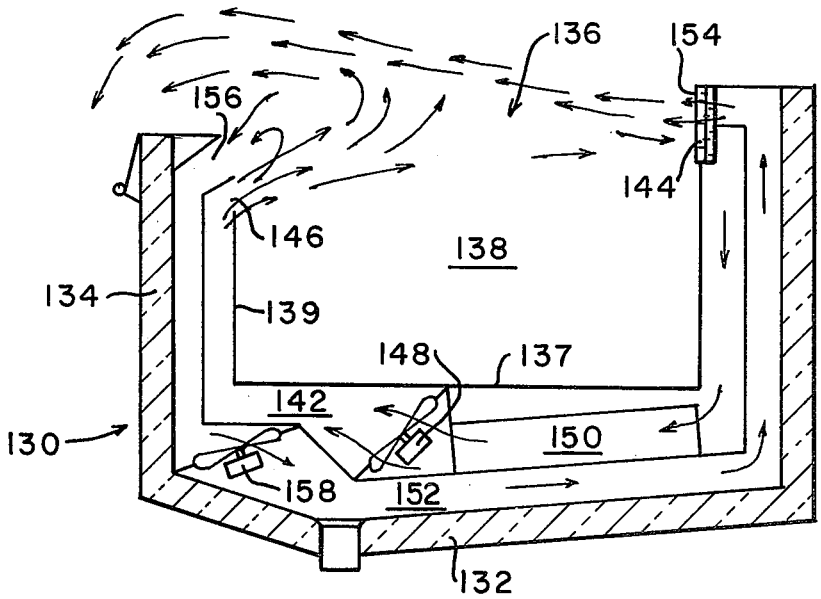
FIG. 5 shows the open top refrigerated display case in the defrost mode of the invention.

FIGS. 4–5 show a well-type refrigerated display case incorporating the air defrost arrangement of this invention. Display case 130 comprises an outer cabinet having a bottom 132 and side walls 134 with an access opening 136 at its top for permitting access to products stored within a display space 138 defined by an inner bottom 137 and inner side walls 139. An inner or primary air conduit 142 extends around the display case 130 adjacent the display space bottom 137 and side walls 139. Inner air conduit 142 has an air outlet opening 144 at one end and an air inlet opening or return 146 at its opposite end. Openings 144 and 146 are arranged at opposite sides of top access opening 138 and are substantially aligned so that air exiting from outlet opening 144 is directed across top access opening 136 toward and into inlet opening or return 146 so as to re-enter the conduit 142. Surrounding inner air conduit 142 is an outer or secondary air conduit 152. Outer air conduit 152 has an outlet opening 154 at one end and an inlet opening or return 156 at its opposite end, with such openings being arranged at opposite sides of opening 136 at the top of the display case. Again, openings 154 and 156 are constructed and substantially aligned so that air exiting from outlet opening 154 is directed across access opening 136 towards inlet opening 156 so that such air re-enters the conduit.

One or more fans 148 are located within inner air conduit 142. Similarly one or more fans 158 are located in outer conduit 152. The number of fans can vary depending on the size of the display case, the size of the fans and desired air flow rates. Fans 148 are preferably of the reversible motor type; however, any other suitable mechanism, such as shown in the Subera '720 patent, may be used which permits the air flow direction to be selectively reversed in conduit 142.

Located within inner air conduit 142 are one or more evaporator coils 150. The evaporator coils refrigerate the air circulated through conduit 142 during a refrigeration cycle; coils 150 are shut off in the defrost cycle, as is known to those skilled in the design, construction and operation of commercial refrigeration apparatus.

During the refrigeration cycle of case 130, shown in FIG. 4, a continuous air band is established through the inner or primary air conduit 142, with an air curtain of refrigerated air being established across opening 136 at the top of the display case. An outer air band of cool but unrefrigerated air is established through secondary conduit 152 with an appropriate curtain of cool air extending across access opening 136.

During the defrost cycle, shown in FIG. 5, refrigerant flow through evaporator coil 150 is shut off and the direction of air flow through primary conduit 142 is reversed. The air flow rate and direction through secondary conduit 152 are maintained substantially the same in the defrost cycle as in the refrigeration cycle. During the defrost cycle, therefore, a negative pressure is maintained at primary conduit outlet 144 and a positive pressure is developed at primary conduit return 146. Likewise a positive pressure is maintained at secondary conduit outlet 154 and a negative pressure is maintained at secondary conduit inlet 156.

During the defrost cycle, a first portion of the inner air band travels from inlet 146 to outlet 144, across access opening 138, thereby creating a disturbance in the laminer flow pattern between the inner and outer air curtains. The disturbed portion of the outer air curtain, which is warmer than the inner air curtain, will be short circuited and mixed with the inner air curtain to be returned to inner air conduit 142 through outlet opening 144. A second portion of air exiting from inner conduit inlet 146 at a relatively acute angle (preferably on the order of about 45° to a nominal horizontal plane) compared to the substantially horizontal flow pattern across access opening 138 will collide with the secondary air curtain moving in the opposite direction from outlet 154 toward inlet 156. This second portion of air exiting from the primary conduit will therefore reverse direction, as shown by the arrows in FIG. 5. Some of the reversed primary air will flow over the top of the case and down the front; the remainder of the reversed primary air flow will be short circuited and returned to the secondary band conduit 152 under the influence of the moving secondary band curtain and the negative pressure at secondary return 156.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A refrigerated display case comprising:

a cabinet having a display space and an access opening permitting access to the interior of said display space;

an inner air conduit passing around said display space and having a first air outlet adjacent one side of said access opening and a first air inlet adjacent an opposite side of said access opening;

first air circulating means for circulating air through said inner air conduit and across said access opening between said first outlet and first inlet to establish a primary air band and a primary air cutrain in a refrigeration mode;

refrigeration means for cooling air passing through said inner air conduit during the refrigeration cycle of operation of said display case and being capable of being shut off during a defrost cycle of operation;

a secondary air conduit passing around said cabinet adjacent to said inner air conduit but outwardly therefrom and having a second air outlet adjacent one side of said access opening and a second air inlet located adjacent an opposite side said access opening;

second air circulating means for circulating air through said secondary air conduit and across said access opening between said second oulet and second inlet to establish a secondary air band with a secondary air curtain in the refrigeration mode; and defrost cycle control means, including means for reversing the air flow direction of said first air circulating means during a defrost cycle, and means for maintaining the air flow direction of said second air circulating means continuously in the same direction during both refrigeration and defrost cycles, the first inlet region and second outlet region being so aligned as to cause primary band air flowing out of the first inlet to collide with secondary band air flowing out of the second outlet during a defrost cycle, said secondary band air flow substantially reversing the primary band air flow direction, whereby a substantial portion of said primary band air flows outside the display case adjacent the inlet region thereof and adjacent the front of the display case.

2. A refrigerated display case according to claim 1, wherein a first portion of said primary band air flows partially into said second inlet and a second portion of said primary band air flows outside the case passing close to the first and second inlet regions and downwardly adjacent the front of the display case.

3. A refrigerated display case comprising; an upright cabinet having a display space and a front access opening permitting access to the interior of said display space;

an inner air conduit passing around said display space and having a first air outlet adjacent the top of said access opening and a first air inlet adjacent the bottom of said access opening;

first air circulating means for circulating air through said inner air conduit and downwardly across said front access opening between said first outlet and first inlet to establish an inner air band and an inner air curtain in a refrigeration mode;

refrigeration means for cooling air passing through said inner air conduit during the refrigeration cycle of operation of said display case and being capable of being shut off during a defrost cycle of operation;

a secondary air conduit passing around said cabinet adjacent to said inner air conduit but outwardly therefrom and having a second air outlet adjacent the top of said access opening and a second air inlet located adjacent the bottom of said access opening;

second air circulating means for circulating air through said secondary air conduit and across said access opening between said second outlet and second inlet to establish a secondary air band with a secondary air curtain in the refrigeration mode; and defrost cycle control means, including means for reversing the air flow direction of said first air circulating means during a defrost cycle, and means for maintaining the air flow direction of said second air circulating means continuously in the same direction during both refrigeration and defrost cycles, the first inlet region and second outlet region being so aligned to cause primary band air flowing upwardly out of the first inlet to collide with secondary band air flowing downwardly out of the second outlet during a defrost cycle, said secondary band air flow substantially reversing the primary band air flow direction, whereby at least a substantial portion of said reversed primary band air flow is directed downwardly outside the case adjacent the front of the case.

4. A refrigerated display case according to claim 3, wherein a first portion of said primary band air flows partially into said second inlet and a second portion of said primary band air flows downwardly outside the case passing close to the inlet regions and along the front of the case toward the floor.

5. A refrigerated display case according to claim 1 or 3, wherein said second air circulating means maintains said secondary band air flow at substantially the same velocity and volume during both the refrigeration and defrost cycles.

6. A refrigerated display case comprising:

an open top cabinet having a well type display space and a top access opening permitting access to the interior of said display space;

an inner air conduit passing around said display space and having a first air outlet adjacent one side of said access opening and a first air inlet adjacent an opposite side of said access opening;

first air circulating means for circulating air through said inner air conduit and across the top of said access opening between said first outlet and first inlet to establish a primary air band and a primary air curtain in a refrigeration mode;

refrigeration means for cooling air passing through said inner air conduit during the refrigeration cycle of operation of said display case and being capable of being shut off during a defrost cycle of operation;

a secondary air conduit passing around said cabinet adjacent to said inner air conduit but outwardly therefrom and having a second air outlet adjacent one side of said access opening and a second air inlet located adjacent an opposite side said access opening;

second air circulating means for circulating air through said secondary air conduit and across the top of said access opening between said second outlet and second inlet to establish a secondary air band with a secondary air curtain in a refrigeration mode; and defrost cycle control means, including means for reversing the air flow direction of said first air circulating means during a defrost cycle, and means for maintaining the air flow direction of said second air circulating means continuously in the same direction during both refrigeration and defrost cycles, the first inlet region and second outlet region being so aligned to cause primary band air flowing in reverse direction across the open top of the case to collide with secondary band air flowing out of the second outlet, whereby a substantial portion of said primary band air flow is further reversed under the influence of the continuously maintained secondary air band and is caused to flow outwardly over the top of the display case and downwardly adjacent the exterior of the display case.

7. A refrigerated display case according to claim 6, wherein, during the defrost cycle, a first portion of said primary band air flows toward and into said outlet and a second portion of said primary band air is further reversed under the influence of the continuously maintained secondary air band and is caused to flow outwardly over the top of the display case and downwardly adjacent the exterior of the display case.

8. A refrigerated display case according to claim 6 or 7, wherein, during the defrost cycle, a first portion of the further reversed primary band air is directed toward and into said second inlet and a further portion of the further reversed primary band air is caused to flow outwardly over the top of the display case and downwardly adjacent the exterior of the display case.

9. A refrigerated display case according to claim 8, wherein the first inlet is disposed to direct air outwardly therefrom during defrost at an angle above a nominal horizontal plane.

10. A refrigerated display case according to claim 9, wherein said angle is approximately 45° to said nominal horizontal plane.

* * * * *